US009763010B2

(12) United States Patent
Huang

(10) Patent No.: US 9,763,010 B2
(45) **Date of Patent: *Sep. 12, 2017**

(54) VIBRATION UNIT FOR ACOUSTIC MODULE

(71) Applicant: Hsin Min Huang, Ningbo (CN)

(72) Inventor: Hsin Min Huang, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/183,759

(22) Filed: Jun. 15, 2016

(65) Prior Publication Data

US 2016/0295332 A1 Oct. 6, 2016

Related U.S. Application Data

(63) Continuation of application No. 14/501,040, filed on Sep. 30, 2014.

(51) Int. Cl.

| | |
|---|---|
| ***H04R 9/06*** | (2006.01) |
| ***H04R 7/20*** | (2006.01) |
| ***H04R 7/16*** | (2006.01) |
| ***H04R 9/04*** | (2006.01) |
| ***H04R 7/18*** | (2006.01) |
| ***H04R 1/28*** | (2006.01) |
| ***H04R 7/04*** | (2006.01) |

(52) U.S. Cl.

CPC ..... *H04R 7/20* (2013.01); *H04R 1/2834* (2013.01); *H04R 7/04* (2013.01); *H04R 7/16* (2013.01); *H04R 7/18* (2013.01); *H04R 9/043* (2013.01); *H04R 2307/207* (2013.01); *H04R 2400/07* (2013.01)

(58) Field of Classification Search

CPC ... H04R 7/04; H04R 7/06; H04R 7/14; H04R 7/18; H04R 7/20; H04R 9/04; H04R 9/043; H04R 9/06; H04R 2207/021; H04R 2307/207; H04R 2400/07

USPC ..... 381/386, 396, 398, 403, 404, 405, 423, 381/424, 431, 432, 433; 181/151, 171, 181/172, 173

See application file for complete search history.

(56) References Cited

U.S. PATENT DOCUMENTS

| | | | | |
|---|---|---|---|---|
| 6,851,513 | B2 * | 2/2005 | Stead | G10K 13/00 181/157 |
| 8,208,677 | B2 * | 6/2012 | Chan | C01B 3/38 181/171 |
| 2003/0190051 | A1 * | 10/2003 | Williamson | H04R 9/06 381/398 |

* cited by examiner

*Primary Examiner* — Huyen D Le
(74) *Attorney, Agent, or Firm* — Raymond Y. Chan; David and Raymond Patent Firm

(57) ABSTRACT

A vibration unit includes an encircling frame defining a vibration cavity therewithin, a vibration member disposed in the vibration cavity, and a suspension including an elastic diaphragm having a periodical wave-shape extended between the vibration member and the encircling frame to support the vibration member within the vibration cavity. The wave-shape diaphragm provides a 3-dimensional connection between the vibration member and the encircling frame to self-generate a repelling force to against a lateral movement of the vibration member so as to ensure the vibration member to be reciprocatingly moved in a linear direction.

20 Claims, 11 Drawing Sheets

VIBRATION UNIT FOR ACOUSTIC MODULE

CROSS REFERENCE OF RELATED APPLICATION

This is a Continuation application that claims the benefit of priority under 35U.S.C. §119 to a non-provisional application, application Ser. No. 14/501,040, filed Sep. 30, 2014.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a diaphragm for an acoustic device, and more particular to a vibration unit for an acoustic module, wherein the vibration unit comprises a suspension having a wavy configuration to ensure the vibration unit to be reciprocatingly moved in one direction for sound reproduction.

Description of Related Arts

A conventional acoustic device, such as a speaker, generally comprises a speaker frame, a vibration diaphragm supported by the speaker frame, a voice coil coupled at the vibration diaphragm, and a magnetic coil unit magnetically inducing with voice coil in order to drive the vibration diaphragm to vibrate for sound reproduction. In particular, the vibration diaphragm is mounted at an opening of the speaker frame, wherein when the voice coil is magnetically induced to reciprocatingly move, the vibration diaphragm is driven to vibrate correspondingly. However, the vibration direction of the vibration diaphragm is uncontrollable, such that the vibration diaphragm cannot reproduce good sound quality. In order to achieve better sound quality, the vibration diaphragm should only be reciprocatingly moved one direction with even amplitude. For example, when the vibration diaphragm is placed horizontally, the vibration diaphragm should only be reciprocatingly moved in a vertical (up-and-down) direction while the upward displacement of the vibration diaphragm should be the same as the downward displacement of the vibration diaphragm.

In order to enable the reciprocatingly movement of the vibration diaphragm, the vibration diaphragm comprises a suspension extended to the speaker frame as a surrounding of the vibration diaphragm. Accordingly, the suspension is made of elastic material and is formed in U-shape such that the suspension provides an elastic force to enable the vibration diaphragm to be reciprocatingly moved in response to the movement of the voice coil. However, the suspension not only allows the vibration diaphragm to move in a vertical direction, for example, but also unavoidably permits the vibration diaphragm to move in a lateral direction. Accordingly, the unwanted lateral movement of the vibration diaphragm will cause the unbalanced movement of the voice coil. Once the movement of the voice coil is not aligned with its center axis, the voice coil may scratch the inner side of the speaker frame. The protective coating of the voice coil will be gradually damaged. The peak of the suspension is upwardly protruded from a top side of the vibration diaphragm, such that the vibration diaphragm requires relatively larger space to incorporate with the suspension. The protruding portion of the suspension will be damaged easily by any external object.

Furthermore, due to the U-shaped cross section of the suspension, the upward displacement of the vibration diaphragm is not the same as the downward displacement thereof. In other words, the vibration diaphragm is not reciprocatingly moved in a linear manner. For example, when the suspension has the inverted U-shaped cross section, the upward displacement of the vibration diaphragm is larger than the downward displacement thereof. Especially for the acoustic device to generate the sound at low frequency, the vibration diaphragm requires relatively large amplitude to be reciprocatingly vibrated. In other words, the suspension will affect the sound reproduction at low frequency.

The size of the vibration diaphragm must be large enough to enable the vibration diaphragm to be vibrated via the suspension. In other words, the size of the speaker must provide enough installation space to hold the vibration diaphragm in position. Therefore, the structure of the speaker with this vibration diaphragm cannot be incorporated with any compact sized electronic device such as laptop, tablet, flat panel television, or mobile phone.

SUMMARY OF THE PRESENT INVENTION

The invention is advantageous in that it provides a vibration unit for an acoustic module, wherein the vibration unit comprises a suspension having a wavy configuration to ensure the vibration unit to be reciprocatingly moved in one linear direction for sound reproduction.

Another advantage of the invention is to provide a vibration unit for an acoustic module, wherein the suspension provides a 3-dimensional connection between a vibration member and an encircling frame. The 3-dimensional connection of the suspension will enhance the secure structure to the vibration member and the encircling frame. The 3-dimensional connection of the suspension will also self-generate a repelling force to against a lateral movement of the vibration member so as to ensure the vibration member to be reciprocatingly moved in a linear direction. In other words, any unwanted lateral or radial movement of the vibration member will be restricted by the wave-shaped suspension to ensure the vibration member to be reciprocatingly moved in one linear direction.

Another advantage of the invention is to provide a vibration unit for an acoustic module, wherein the wavy body of the suspension will generate a pulling force in different directions in response to the displacement of the vibration member so as to stabilize the reciprocating movement of the vibration member in a linear direction.

Another advantage of the invention is to a vibration unit for an acoustic module, wherein the suspension provides higher sound quality, improve durability, and enhance safety for the acoustic module.

Another advantage of the invention is to a vibration unit for an acoustic module, wherein the suspension requires minimum installation space in the frame, such that the acoustic module is adapted to equip with any compact product.

Another advantage of the invention is to a vibration unit for an acoustic module, wherein the manufacturing steps for making the vibration unit is simple so as to lower the manufacturing cost while being time effective.

Another advantage of the invention is to a vibration unit for an acoustic module, which does not require to alter the original structural design of the acoustic module, so as to minimize the manufacturing cost of the acoustic module incorporating with the vibration unit.

Another advantage of the invention is to a vibration unit for an acoustic module, wherein no expensive or complicated structure is required to employ in the present invention in order to achieve the above mentioned objects. Therefore, the present invention successfully provides an economic and efficient solution for providing a compact configuration for the acoustic module and for enhancing the output sound quality.

Additional advantages and features of the invention will become apparent from the description which follows, and may be realized by means of the instrumentalities and combinations particular point out in the appended claims.

According to the present invention, the foregoing and other objects and advantages are attained by a vibration unit for an acoustic module which comprises a voice coil being induced to reciprocatingly move, wherein the vibration unit comprises:

- an encircling frame defining a vibration cavity therewithin;
- a vibration member disposed in said vibration cavity of said encircling frame; and
- a suspension comprising an elastic diaphragm having an inner edge extended from said vibration member and an outer edge extended to said encircling frame to support said vibration member within said vibration cavity.

Accordingly, the inner edge of the diaphragm has a periodically wave-shaped configuration extended from the vibration member to ensure the vibration member to be reciprocatingly moved in a linear direction in response to a movement of the voice coil for sound reproduction.

In accordance with another aspect of the invention, the outer edge of the diaphragm has a periodically wave-shaped configuration extended to the encircling frame to ensure the vibration member to be reciprocatingly moved in a linear direction in response to a movement of the voice coil for sound reproduction.

In accordance with another aspect of the invention, both the inner and outer edges of the diaphragm have a periodically wave-shaped configuration extended between the vibration member and the encircling frame to ensure the vibration member to be reciprocatingly moved in a linear direction in response to a movement of the voice coil for sound reproduction.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
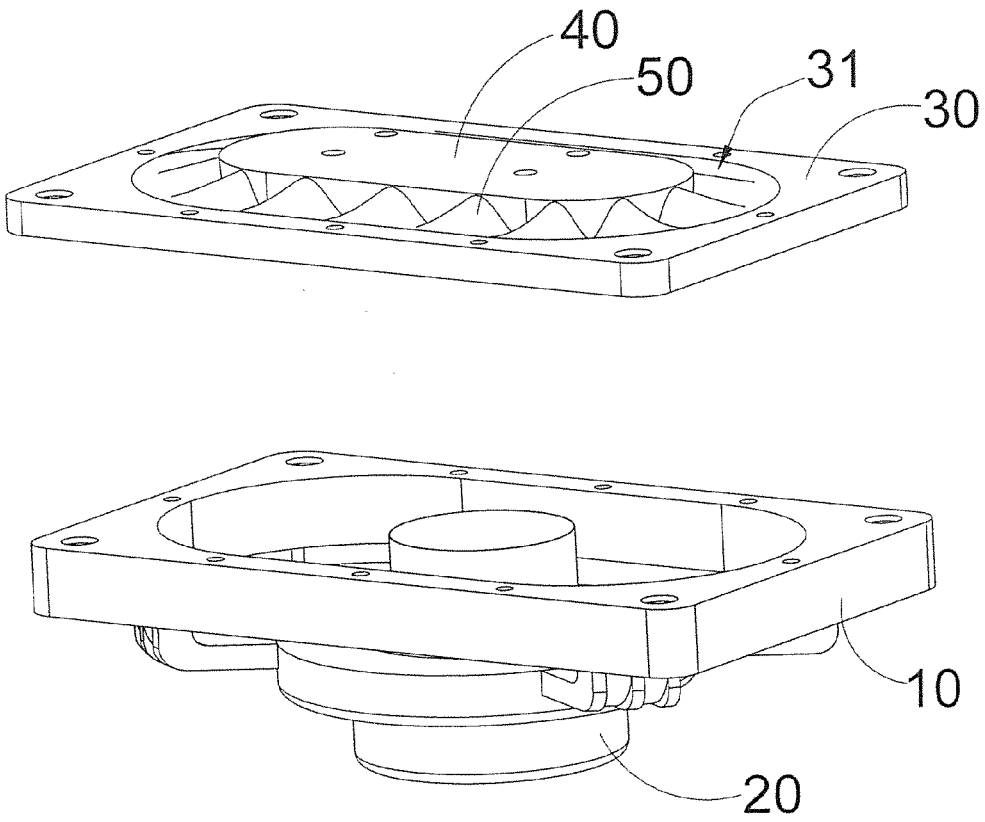
FIG. 1 is a perspective view of an acoustic module with a vibration unit according to a first preferred embodiment of the present invention.

Referring to FIG. 1 of the drawings, an acoustic module according to a preferred embodiment of the present invention is illustrated, wherein the acoustic module can be formed as a speaker module or equipped with another acoustic module to form a speaker assembly. According to the preferred embodiment, the acoustic module comprises a supporting frame 10, an electromagnetic generator 20, and a vibration unit for providing a vibration effect in response to the electromagnetic generator 20. Accordingly, the electromagnetic generator 20 comprises a magnetic coil system and a voice coil communicating with the magnetic coil system. The vibration unit of the present invention can be directly coupled with the voice coil of the electromagnetic generator 20 such that the vibration unit is reciprocatingly moved when the voice coil of the electromagnetic generator 20 is induced to reciprocatingly move. Or, the vibration unit can be a passive vibration unit to incorporate with an existing acoustic device such that when the vibration diaphragm of the existing acoustic device is vibrated by the voice coil, the vibration unit of the present invention is driven to reciprocatingly move by means of air pressure in an interior air-sealed chamber of the existing acoustic device.

It is worth mentioning that the acoustic module of the present invention can be placed at a vertical orientation or a horizontal orientation. At the vertical orientation, the voice coil of the electromagnetic generator 20 is reciprocatingly moved in a front-and-back direction that the vibration unit is driven to reciprocatingly move in a front-and-back (horizontal) direction. At the horizontal orientation, the voice coil of the electromagnetic generator 20 is reciprocatingly moved in an up-and-down (vertical) direction that the vibration unit is driven to reciprocatingly move in an up-and-down direction. For easily understanding, the acoustic module of the present invention is described at the horizontal orientation.

According to the preferred embodiment, the vibration unit comprises an encircling frame 30 defining a vibration cavity 31 therewithin, and a vibration member 40 disposed in the vibration cavity 31 of the encircling frame 30. The vibration unit further comprises a suspension formed within the vibration cavity 31 and extended between the vibration member 40 and the encircling frame 30 to ensure the vibration member 40 to be reciprocatingly moved in a linear direction within the vibration cavity 31 in response to a movement of the voice coil for sound reproduction. The encircling frame 30 can be mounted to the supporting frame 10 of the acoustic module in order to incorporate the acoustic module with the vibration unit of the present invention.

Figure 2:
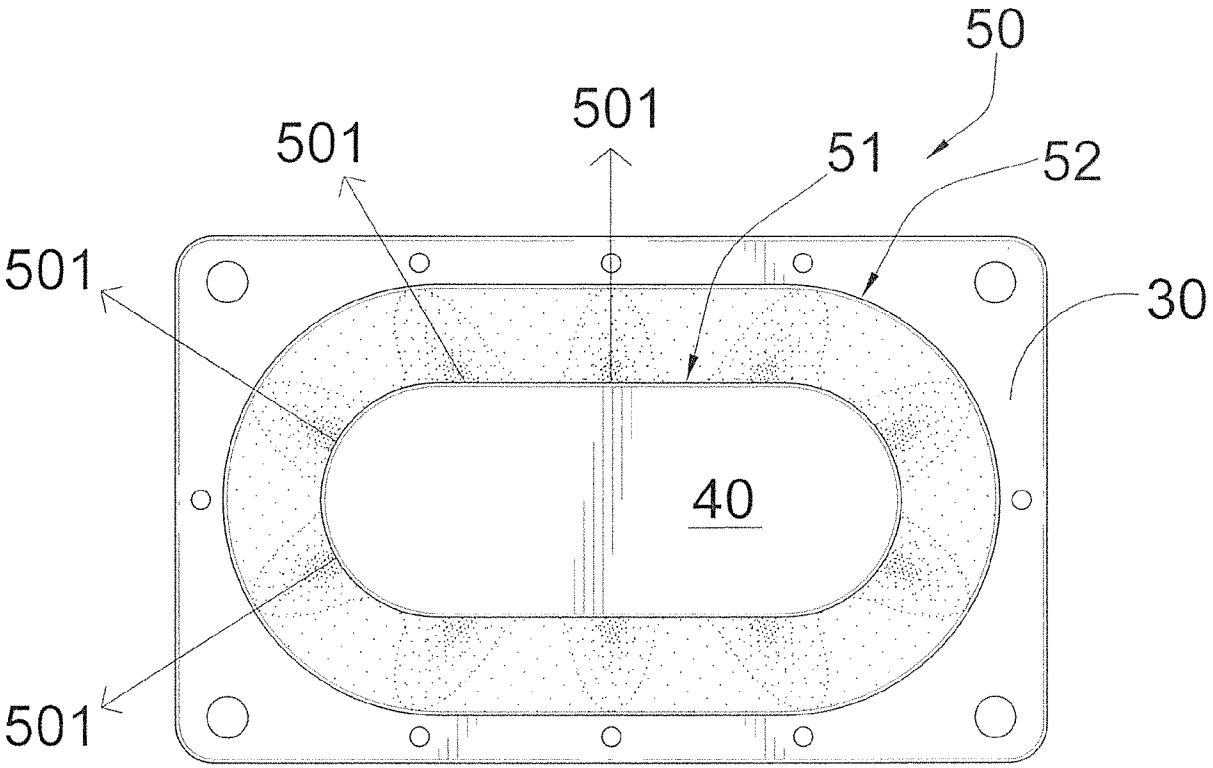
FIG. 2 is a top view of the vibration unit according to the first preferred embodiment of the present invention.

As shown in FIGS. 1 to 4, the encircling frame 30 has a planar structure defining an outer edge and an inner edge, wherein the vibration cavity 31 is formed within the inner edge of the encircling frame 30. Preferably, the encircling frame 30 is made of rigid material, such as metal, to support and retain the vibration unit in shape. As shown in FIG. 2, the encircling frame 30 has a rectangular shape matching with the shape of the supporting frame 10. In other words, the inner edge of the encircling frame 30 has two longitudinal edge portions, two transverse edge portions, and four round cornering portions. An outer centerline 301 is defined at the encircling frame 30 between the upper and lower sides.

The vibration member 40 is a planar weight member having a predetermined thickness and defining a flat upper side and a flat lower side. In other words, the vibration member 40 gives a predetermined weight to the vibration unit in order to vibrate or move reciprocatingly. The vibration member 40 is also a rigid panel disposed in the vibration cavity 31 in a planar direction. Preferably, the thickness of the encircling frame 30 is smaller than or equals to the thickness of the vibration member 40. An inner centerline 401 is defined at the vibration member 40 between the upper and lower sides when the vibration member 40 is stationary, wherein a distance between the upper side of the vibration member 40 and the inner centerline 401 equals to a distance between the lower side of the vibration member 40 and the inner centerline 401.

The suspension comprises an elastic diaphragm 50 having an inner edge 51 extended from the vibration member 40 and an outer edge 52 extended to the encircling frame 30 to support the vibration member 40 within the vibration cavity 31. Accordingly, the diaphragm 50 has a uniform thickness between the inner and outer edges 51, 52.

According to the preferred embodiment, the inner edge 51 of the diaphragm 50 has a periodically wave-shaped configuration extended from the vibration member 40 to ensure the vibration member 40 to be reciprocatingly moved in a linear direction in response to a movement of the voice coil for sound reproduction.

Figure 3:
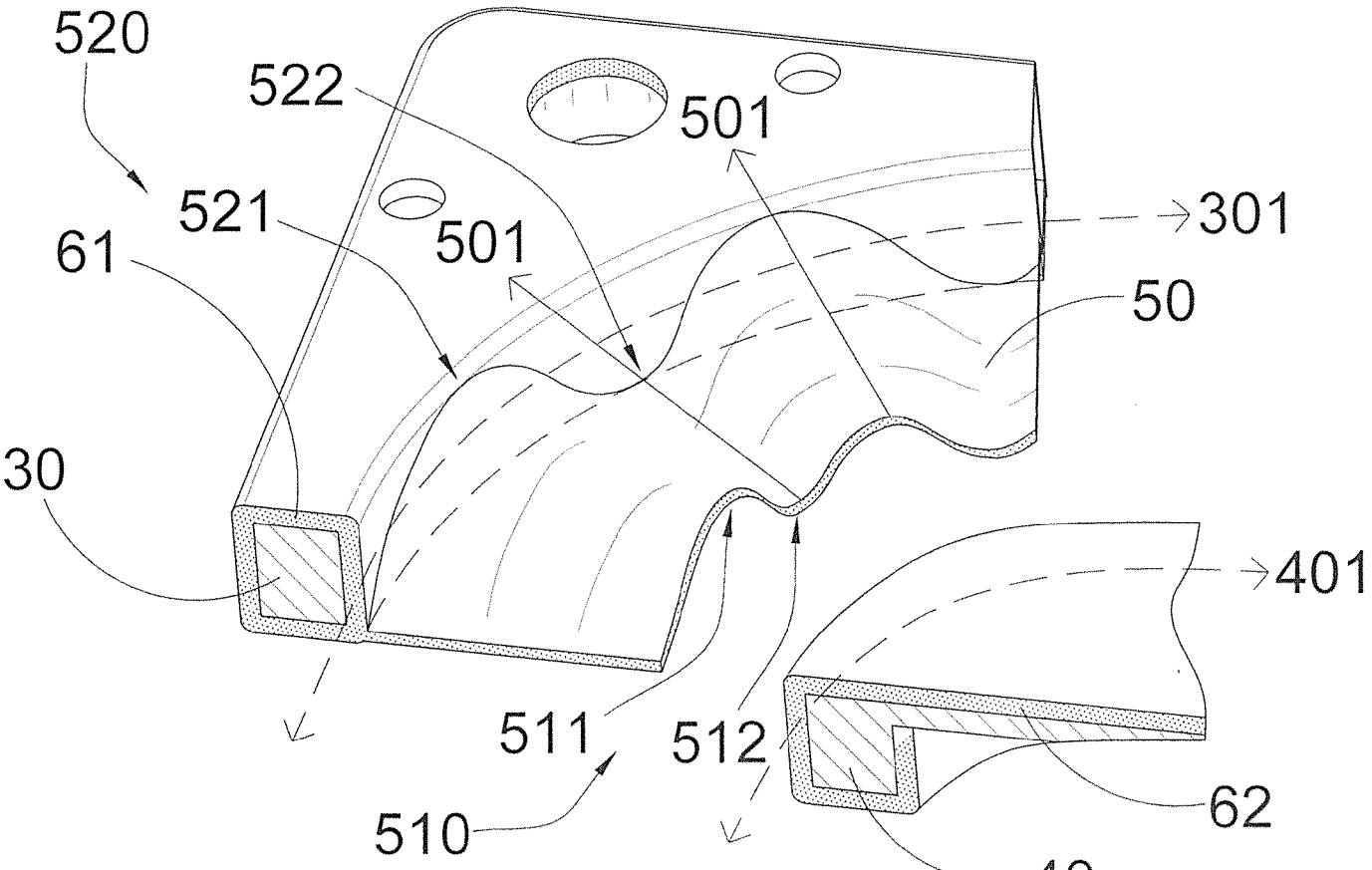
FIG. 3 is a partially perspective view of the vibration unit according to the first preferred embodiment of the present invention, illustrating the wave-shaped inner edge of the diaphragm connecting to the vibration member and the wave-shaped outer edge of the diaphragm connecting to the encircling frame.

As shown in FIG. 3, the inner edge 51 of the diaphragm 50 is formed in periodically sinusoid configuration to connect with an outer edge of the vibration member 40. The periodically sinusoid configuration of the inner edge 51 of the diaphragm 50 defines a plurality of inner edge waveform sectors 510 having the same wavelength integrally extended with each other, wherein each of the inner edge waveform sectors 510 defines an inner edge upper peak 511 and an inner edge lower peak 512. In other words, the inner edge upper peaks 511 are alternating with the inner edge lower peaks 512 to symmetrically encircle around the vibration member 40.

Amplitude of each of the inner edge upper peaks 511 is defined at a vertical distance between the inner edge upper peak 511 and the inner centerline 401. Amplitude of each of the inner edge lower peaks 512 is defined at a vertical distance between the inner edge lower peak 512 and the inner centerline 401. Preferably, the amplitude of each of the inner edge upper peaks 511 equals to the amplitude of each of the inner edge lower peaks 512. It is worth mentioning that the wavy configuration of the inner edge 51 of the diaphragm 50 will increase the contacting surface area to connect with the vibration member 40. In particular, a 3-dimensional connection is formed between the inner edge 51 of the diaphragm 50 and the vibration member 40.

Accordingly, the wave-shaped inner edge 51 of the diaphragm 50 is configured to prohibit the vibration member 40 to be moved in a lateral direction within the vibration cavity 31, i.e. a X-axis or a Y-axis of the vibration member 40 as shown in FIGS. 1 and 2. In particular, if a lateral force is applied at one of the inner edge waveform sectors 510 to move the vibration member 40 in a lateral direction, the adjacent inner edge waveform sectors 510 will generate an opposite repelling force to against and offset the lateral force. As a result, the lateral movement of the vibration member 40 will be substantially minimized. In other words, the vibration member 40 can only moved reciprocatingly in a linear direction, i.e. a Z-axis of the vibration member 40.

It is worth mentioning that when the lateral force is applied to the vibration member 40, the inner edge waveform sectors 510 will generate an opposite repelling force to against and offset the lateral force, such that the lateral force will not be transmitted to the encircling frame 30 through the diaphragm 50 so as to prevent any excessive vibration of the encircling frame 30.

Figure 4:
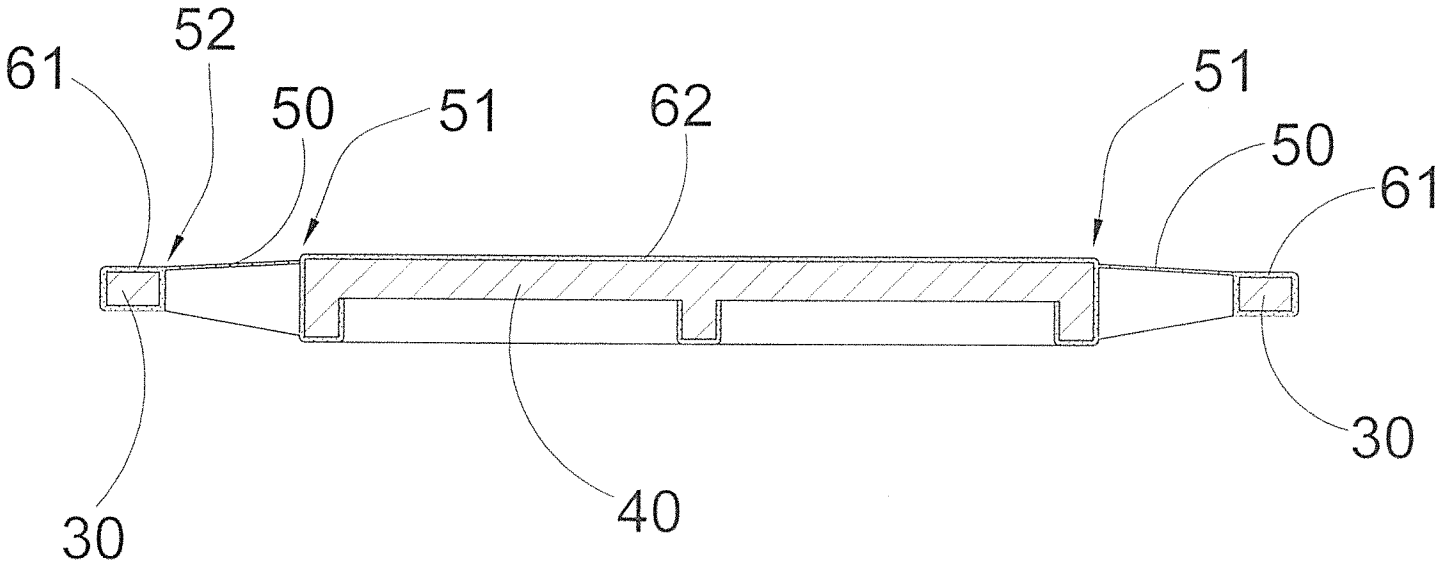
FIG. 4 is a sectional view of the vibration unit according to the first preferred embodiment of the present invention.

Preferably, the inner edge upper peaks 511 are located not higher than the upper side of the vibration member 40 and the inner edge lower peaks 511 are located not lower than the lower side of the vibration member 40, as shown in FIG. 4. In other words, the inner edge upper peaks 511 can be aligned with the upper side of the vibration member 40 or can be located below the upper side of the vibration member 40. Likewise, the inner edge lower peaks 512 can be aligned with the lower side of the vibration member 40 or can be located above the lower side of the vibration member 40.

It is worth mentioning that when the vibration member 40 is moved reciprocatingly in a linear direction, i.e. a Z-axis of the vibration member 40, the inner edge waveform sectors 510 will generate an opposite pulling force to move the vibration member 40 back to its original position, i.e. the inner centerline 401 of the vibration member 40. For example, when the vibration member 40 is moved upwardly, the inner edge waveform sectors 510 below the inner centerline 401 will generate the pulling force to pull down the vibration member 40. When the vibration member 40 is moved downwardly, the inner edge waveform sectors 510 above the inner centerline 401 will generate the pulling force to pull up the vibration member 40. The inner edge waveform sectors 510 above and below the inner centerline 401 will pull the vibration member 40 back to its original position in an alternating manner so as to ensure the reciprocating movement of the vibration member 40 in a balanced and stable manner. In fact, the force to cause the reciprocating movement of the vibration member 40 will not be transmitted to the encircling frame 30.

As shown in FIGS. 1, 2, and 4, the outer edge 52 of the diaphragm 50 also has a periodically wave-shaped configuration extended to the encircling frame 30 to further ensure the vibration member 40 to be reciprocatingly moved in a linear direction.

Accordingly, the outer edge 52 of the diaphragm 50 is formed in periodically sinusoid configuration to connect with an inner edge of the encircling frame 30. The periodically sinusoid configuration of the outer edge 52 of the diaphragm 50 defines a plurality of outer edge waveform sectors 520 having the same wavelength integrally extended with each other, wherein each of the outer edge waveform sectors 520 defines an outer edge upper peak 521 and an outer edge lower peak 522. In other words, the outer edge upper peaks 521 are alternating with the outer edge lower peaks 522 to symmetrically extend to the encircling frame 30.

Likewise, amplitude of each of the outer edge upper peaks 521 is defined at a vertical distance between the outer edge upper peak 521 and the outer centerline 301. Amplitude of each of the outer edge lower peaks 522 is defined at a vertical distance between the outer edge lower peak 522 and the outer centerline 301. Preferably, the amplitude of each of the outer edge upper peaks 521 equals to the amplitude of each of the outer edge lower peaks 522. It is worth mentioning that the wavy configuration of the outer edge 52 of the diaphragm 50 will increase the contacting surface area to connect with the encircling frame 30. In particular, a 3-dimensional connection is formed between the outer edge 52 of the diaphragm 50 and the encircling frame 30.

Having the same wavy configuration, the wave-shaped outer edge 52 of the diaphragm 50 is configured to prohibit the vibration member 40 to be moved in a lateral direction within the vibration cavity 31, i.e. a X-axis or a Y-axis of the vibration member 40 as shown in FIGS. 1 and 2. When the lateral force is applied to the vibration member 40, the outer edge waveform sectors 520 will generate an opposite repelling force to against and offset the lateral force, such that the lateral force will not be transmitted to the encircling frame 30 through the diaphragm 50 so as to prevent any excessive vibration of the encircling frame 30.

Preferably, the outer edge upper peaks 521 are located not higher than the upper side of the encircling frame 30 and the outer edge lower peaks 521 are located not lower than the lower side of the encircling frame 30, as shown in FIG. 4.

According to the preferred embodiment, a phase of the inner edge 51 of the diaphragm 50 is synchronized with a phase of the outer edge 52 of the diaphragm 50. It is worth mentioning that since both the inner and outer edges 51, 52 are formed in wavy configuration, the diaphragm 50 also has a wave shape correspondingly extended between the inner and outer edges 51, 52 to define a plurality of waveform sectors at the diaphragm 50. A width of the waveform sector at the diaphragm 50 is gradually increasing from the inner edge waveform sector 520 is to the outer edge waveform sectors 520. In other words, a width of the inner edge waveform sector 520 is smaller than a width of the outer edge waveform sector 520.

Accordingly, the diaphragm 50 defines a plurality of peak lines 501 radially and outwardly projected from the vibration member 40 to the encircling frame 30, as shown in FIG. 2. In other words, the inner edge upper peaks 511 align with the outer edge upper peaks 521 respectively along a radial direction of the vibration member 40 and along the peak lines 501 of the diaphragm 50. The inner edge lower peaks 512 align with the outer edge lower peaks 522 respectively along the radial direction of the vibration member 40 and along the peak lines 501 of the diaphragm 50.

It is worth mentioning that the number of waveform sector at the diaphragm 50 will affect the linear displacement of the vibration member 40 in response to the same electromagnetic force is generated by the electromagnetic generator 20 to the vibration member 40. When increasing the numbers of waveform sector at the diaphragm 50, the linear displacement of the vibration member 40 will be decreased because of the stronger repelling force being generated. This configuration is suitable to incorporate the vibration unit with the acoustic device to generate the sound at low frequency since the electromagnetic generator 20 will generate a larger electromagnetic force to the vibration member 40. On the other hand, when reducing the numbers of waveform sector at the diaphragm 50, the linear displacement of the vibration member 40 will be increased because of the weaker repelling force being generated.

According to the preferred embodiment, the suspension further comprises a frame retaining edge 61 integrally extended from the outer edge 52 of the diaphragm 50 to affix at the encircling frame 30. In particular, the frame retaining edge 61 is affixed on top of the encircling frame 30, such that the encircling frame 30 is embedded in the frame retaining edge 61 to ensure the outer edge 52 of the diaphragm 50 to be extended at the inner edge of the encircling frame 30, as shown in FIG. 4.

The suspension further comprises a retaining layer 62 integrally extended from the inner edge 51 of the diaphragm 50 to embed the vibration member 40 under the retaining layer 62, so as to retain the vibration member within the vibration cavity 31. Accordingly, the retaining layer 62 is integrally extended from the inner edge 51 of the diaphragm 50 and is affixed on top of the vibration member 40, to ensure the inner edge 51 of the diaphragm 50 to be extended at the outer edge of the encircling frame 30, as shown in FIG. 4.

According to the preferred embodiment, the resonant frequency of the vibration unit is about 5-200 Hz, and the diaphragm 50 can be made of any elastic material, such as thermoset rubber or thermoplastic elastomer. The diaphragm 50 also has a predetermined rigidity, wherein the shore hardness of the diaphragm preferably is about 5-85 A. Preferably, the amplitude of the waveform sector, including the inner and outer edge waveform sectors 510, 520, is about 1-500 mm. Preferably, the number of waveform sector is about 2-100. Preferably, the area of the diaphragm 50 is about 0.005-0.2 $m^2$.

Figure 5:
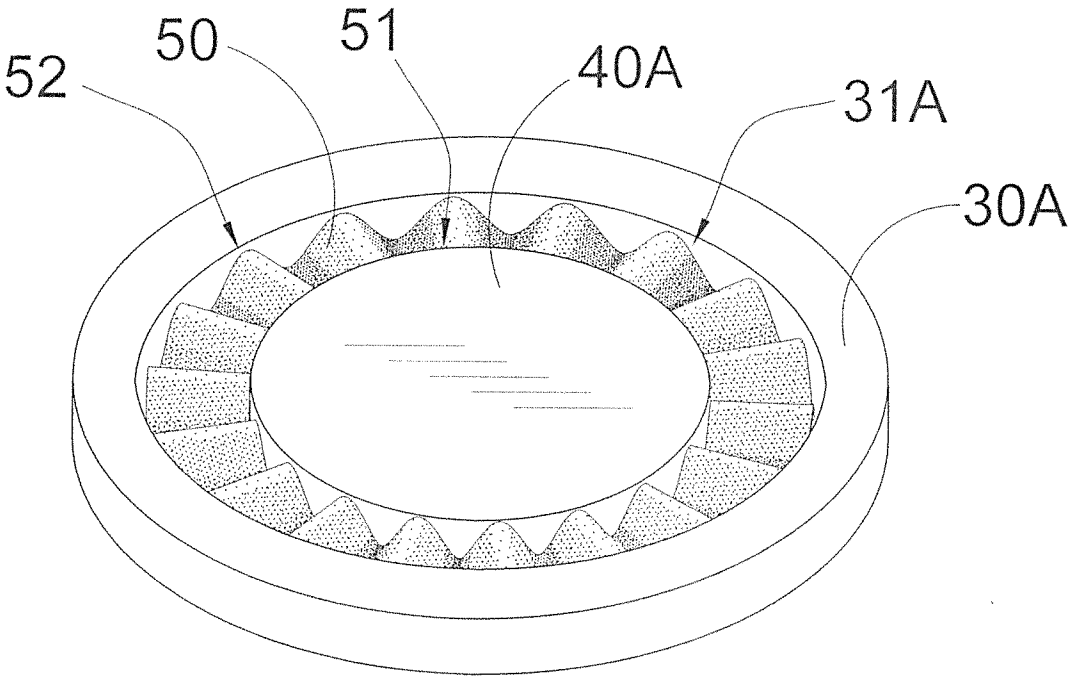
FIG. 5 illustrates an alternative mode of the vibration unit according to the first preferred embodiment of the present invention, illustrating the encircling frame and the vibration member formed in different shapes.

FIG. 5 illustrates the encircling frame 30A and the vibration member 40A formed in a circular shape. In particular, the vibration cavity 31A of the encircling frame 30A has a circular shape, wherein the vibration member 40A is coaxially disposed within the vibration cavity 31A of the vibration member 40A. Therefore, the diaphragm 50 is radially and outwardly extended from the vibration member 40A to the encircling frame 30A at a position that the wavy shaped inner edge 51 of the diaphragm 50 is extended from the vibration member 40A and the wavy shaped outer edge 52 of the diaphragm 50 is extended to the encircling frame 30A.

Figure 6:
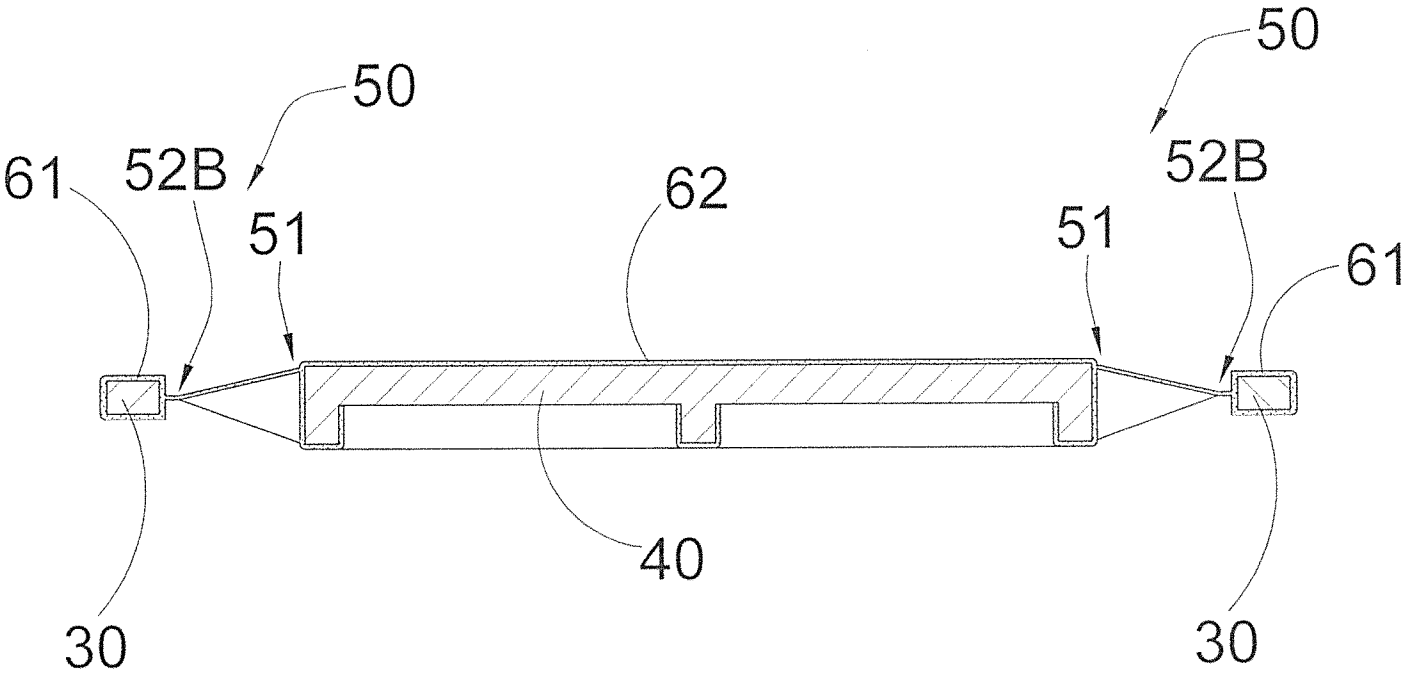
FIG. 6 is a sectional view of a vibration unit according to a second preferred embodiment of the present invention.

As shown in FIG. 6, a vibration unit according to a second preferred embodiment illustrates an alternative mode of the first embodiment, wherein the vibration unit of the second embodiment has the same structural configuration except the outer edge 52B of the diaphragm 50.

Figure 7:
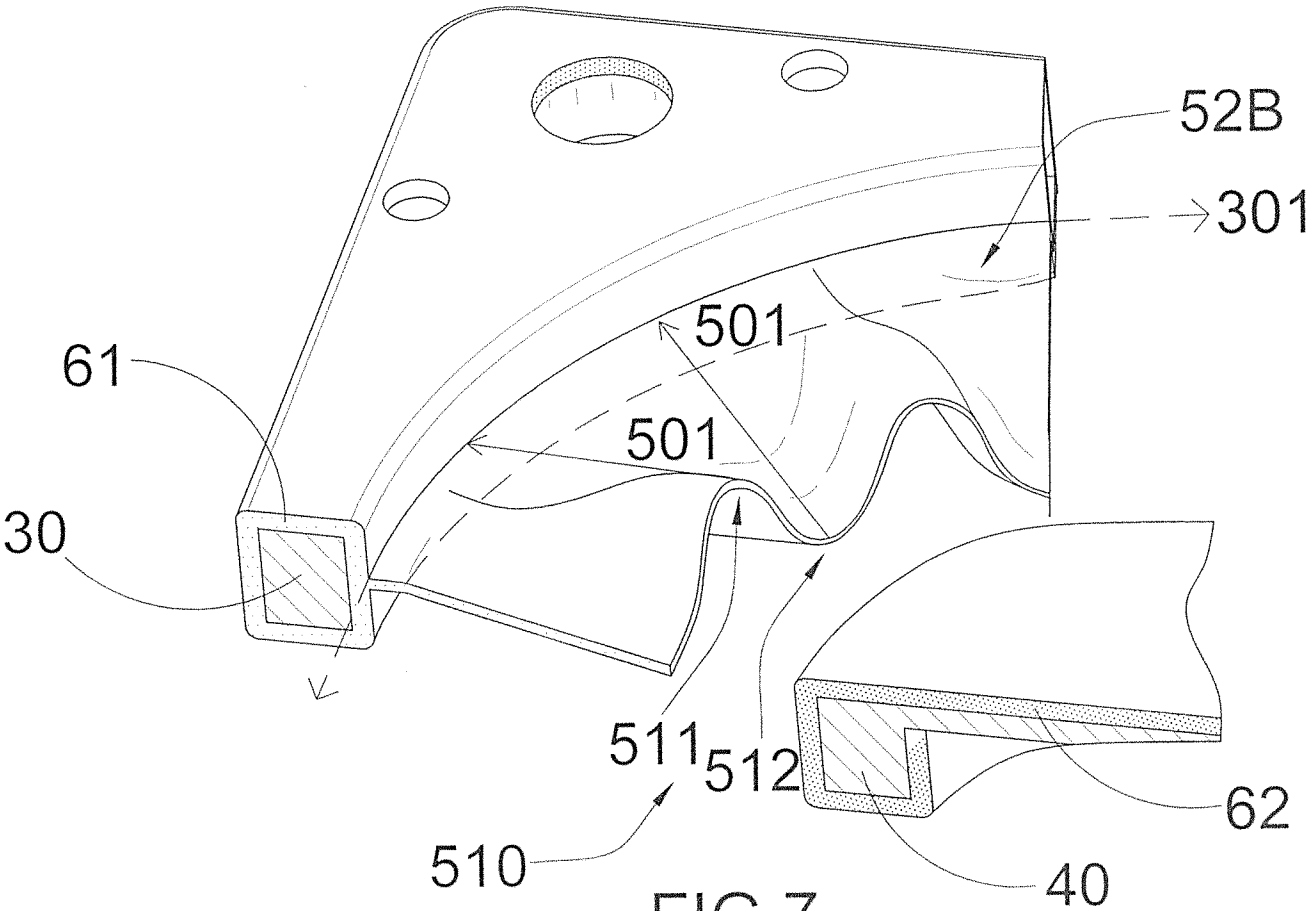
FIG. 7 is a partially perspective view of the vibration unit according to the second preferred embodiment of the present invention, illustrating the flat shaped outer edge of the diaphragm connecting to the encircling frame.

As shown in FIGS. 6 and 7, the amplitude of each of the inner edge upper and lower peaks 511, 512 is gradually reduced from the inner edge 51 of the diaphragm 50 to the outer edge 52B thereof and toward the outer centerline 301 of the encircling frame 30. In particular, the outer edge 52B of the diaphragm 50 has a flat configuration extended to the encircling frame 30 and aligned with the outer centerline 301 of the encircling frame 30. In other words, the peak lines 501 are downwardly extended from the inner edge upper peaks 511 toward the outer edge 52B of the diaphragm 50 at the outer centerline 301, and the peak lines 501 are upwardly extended from the inner edge lower peaks 512 toward the outer edge 52B of the diaphragm 50 at the outer centerline 301.

Figure 8:
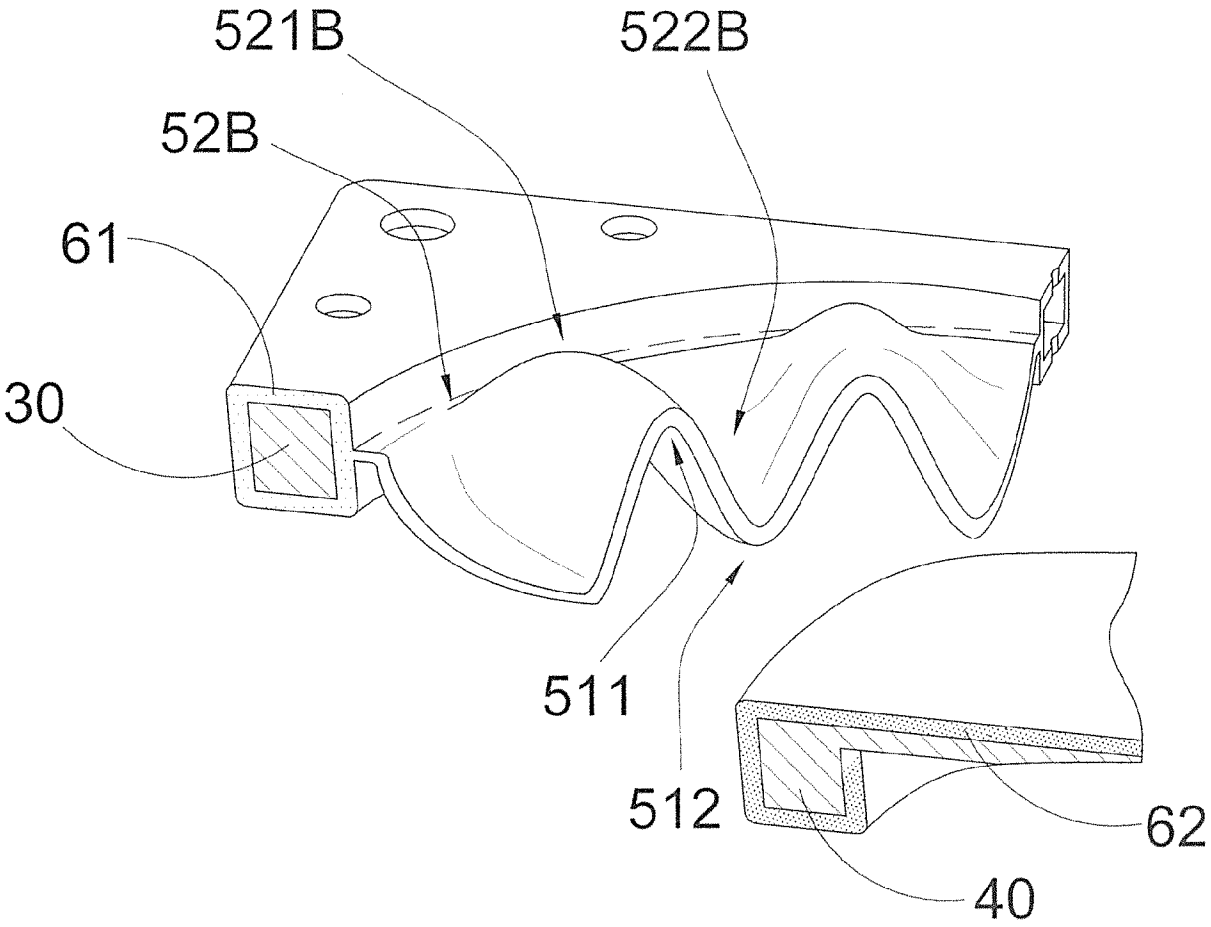
FIG. 8 illustrates an alternative mode of the diaphragm of the vibration unit according to the second preferred embodiment of the present invention.

FIG. 8 illustrates an alternative mode of the diaphragm 50 of the second embodiment. Since the outer edge 52B of the diaphragm 50 has a flat configuration extended to the encircling frame 30, the amplitude each of the outer edge upper and lower peaks 521B, 522B can be enlarged. In particular, the outer edge upper peaks 521B are located higher than the upper side of the encircling frame 30 and the outer edge lower peaks 521C are located lower than the lower side of the encircling frame 30, as shown in FIG. 8. The enlarged amplitude each of the outer edge upper and lower peaks 521B, 522B will increase the linear displacement of the vibration unit 40 that allows the vibration unit 40 to be reciprocatingly moved with larger linear displacement.

Figure 9:
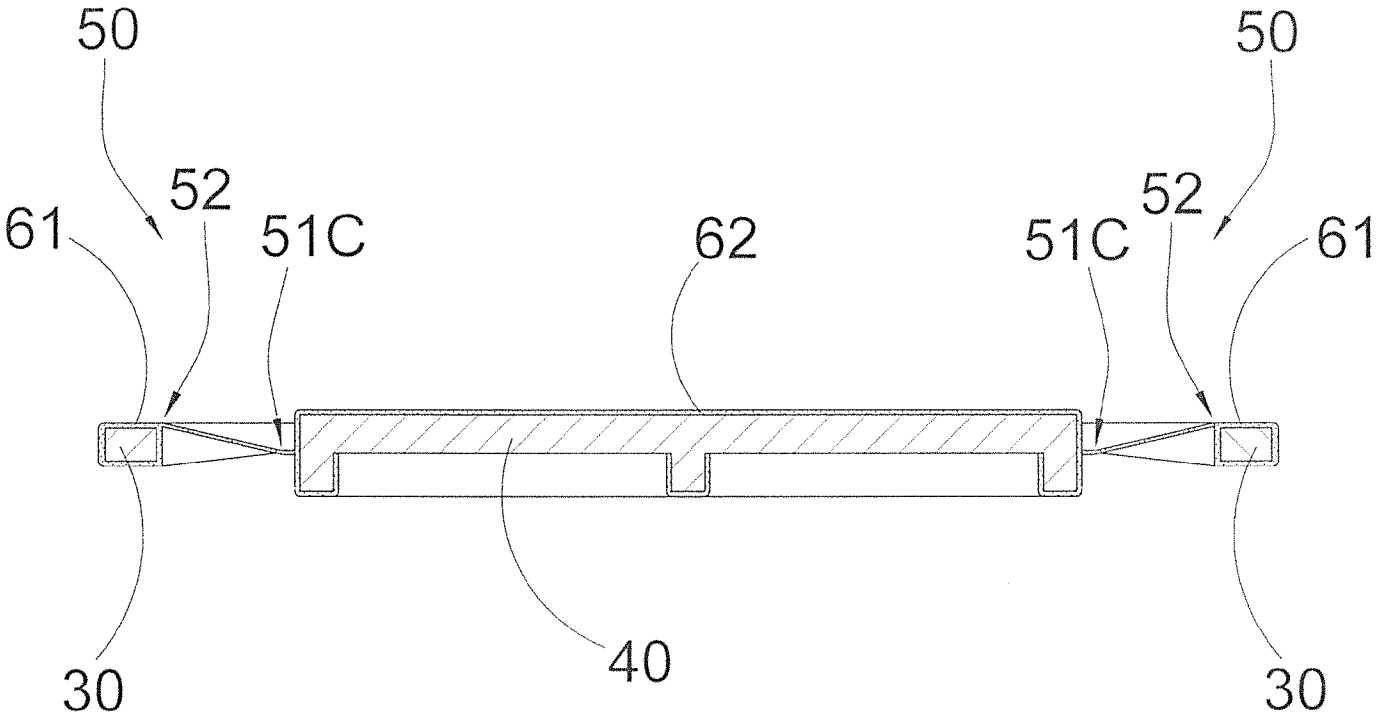
FIG. 9 is a sectional view of a vibration unit according to a third preferred embodiment of the present invention.

As shown in FIG. 9, a vibration unit according to a third preferred embodiment illustrates an alternative mode of the first embodiment, wherein the vibration unit of the third embodiment has the same structural configuration except the inner edge 51C of the diaphragm 50.

Figure 10:
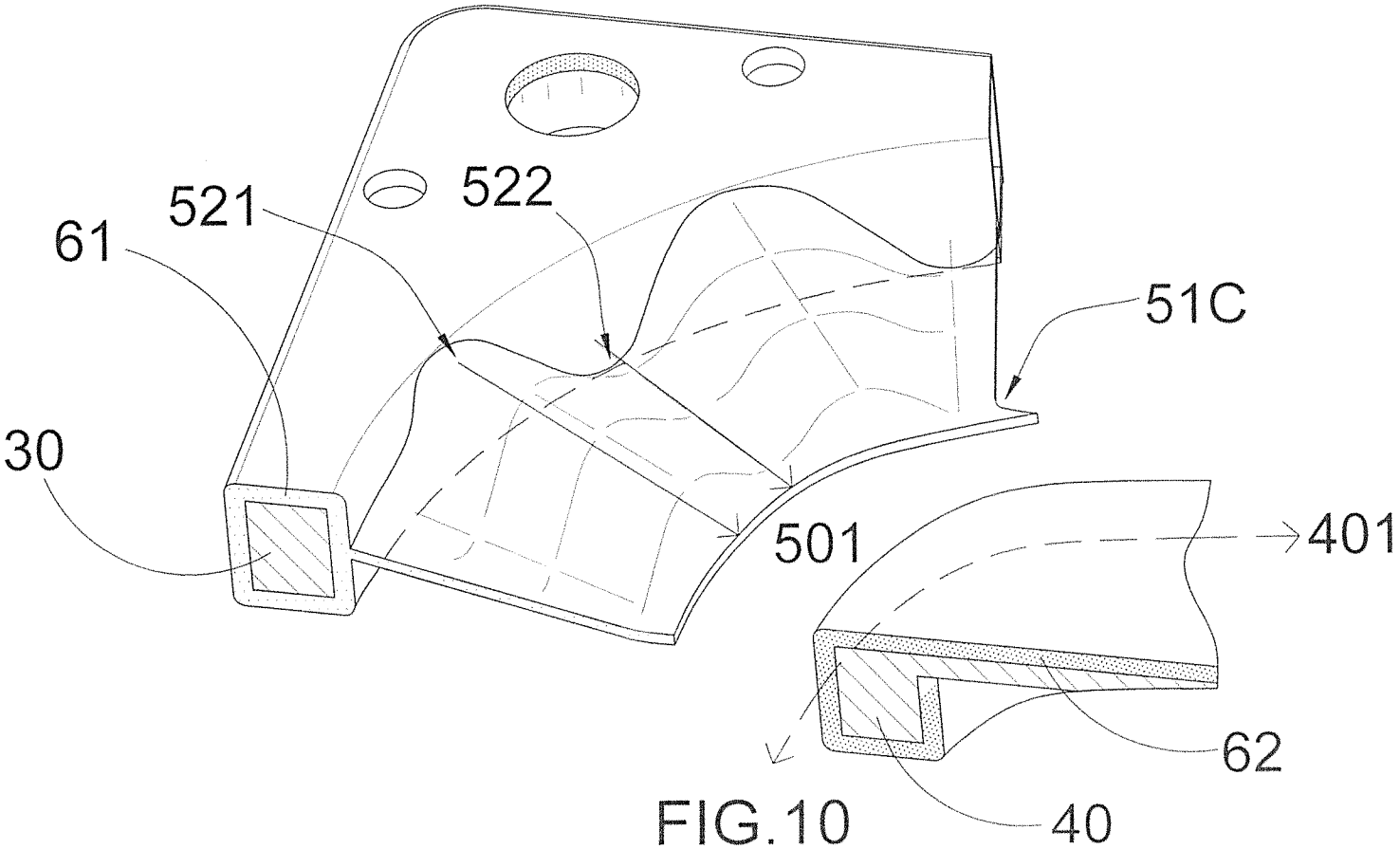
FIG. 10 is a partially perspective view of the vibration unit according to the third preferred embodiment of the present invention, illustrating the flat shaped inner edge of the diaphragm connecting to the vibration member.

As shown in FIGS. 9 and 10, the amplitude of each of the outer edge upper and lower peaks 521, 522 is gradually reduced from the outer edge 52 of the diaphragm 50 to the inner edge 51C thereof and toward the inner centerline 401 of the vibration member 40. In particular, the inner edge 51C of the diaphragm 50 has a flat configuration extended to the vibration member 40 and aligned with the inner centerline 401 of the vibration member 40. In other words, the peak lines 501 are upwardly extended from the inner edge 51C toward the outer edge upper peak 521 of the outer edge 52 of the diaphragm 50, and the peak lines 501 are downwardly extended from the inner edge 51C toward the outer edge lower peak 522 of the outer edge 52B of the diaphragm 50.

Figure 11:
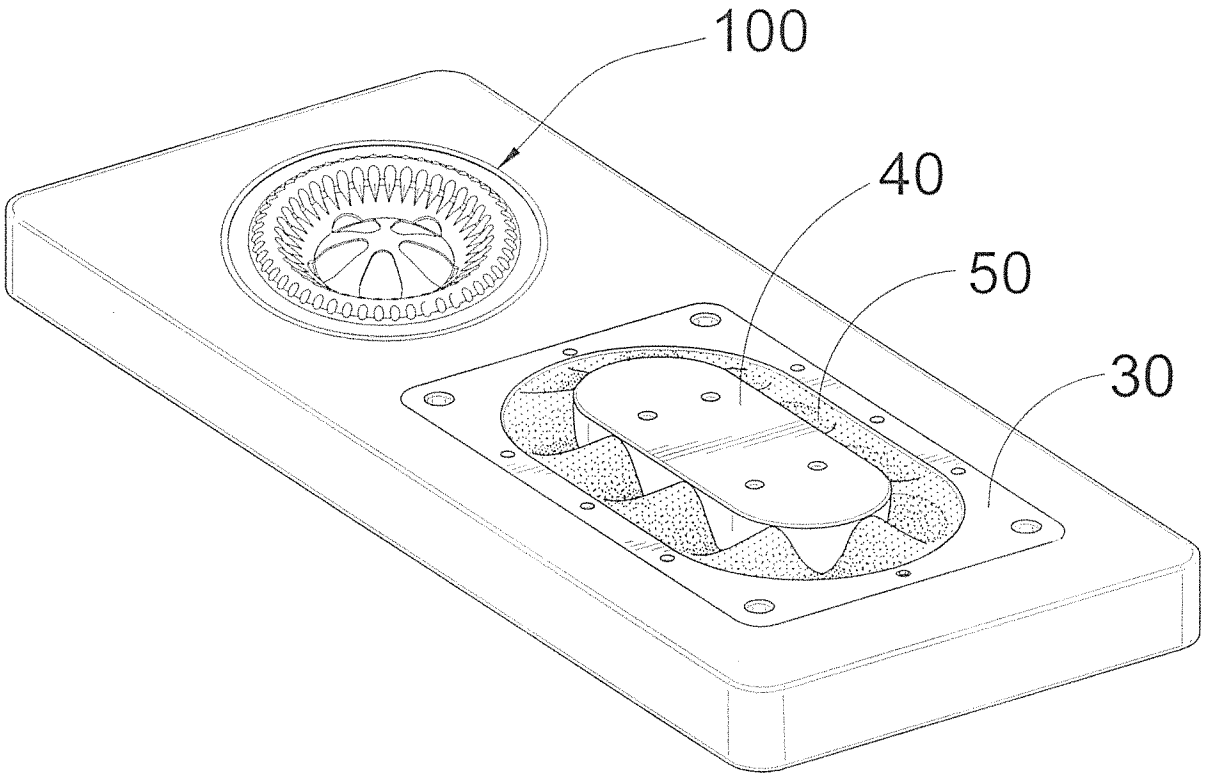
FIG. 11 is a top view of the vibration unit being used as a passive vibration unit to incorporate with an existing acoustic device.

FIG. 11 illustrates the vibration unit is a passive vibration unit to incorporate with an existing acoustic device 100 such that when the vibration diaphragm of the existing acoustic device 100 is vibrated by the voice coil, the vibration unit of the present invention is driven to reciprocatingly move by means of air pressure in an interior air-sealed chamber of the existing acoustic device. It is worth mentioning that the vibration unit according to the first to third embodiments and their alternatives can be formed as the passive vibration unit.

It should be appreciated that the vibration unit can be modified to have both the inner edge 51C and the outer edge 52B of the diaphragm 50 in a flat configuration, wherein only the body portion of the diaphragm 50 between the inner edge 51C and the outer edge 52B has the wavy configuration.

In order to manufacture the vibration unit of the present invention, the encircling frame 30 and the vibration member 40 are placed in a mold at a position that the vibration member 40 is located within the vibration cavity 31, preferably at the center thereof. Then, by mold-injecting raw material of the suspension into the mold, the diaphragm 50 is formed between the encircling frame 30 and the vibration member 40. In addition, the encircling frame 30 is embedded in the frame retaining edge 61 and the vibration member 40 is embedded under the retaining layer 62. By using different shapes of mold, the inner and outer edges 51, 52 of the diaphragm 50 are formed in different configuration. For example, the inner and outer edges 51, 52 of the diaphragm 50 are formed in a wavy configuration. The inner edge 51 of the diaphragm 50 is formed in a wavy configuration while the outer edge 52B of the diaphragm 50 is formed in a flat configuration. Likewise, the outer edge 52 of the diaphragm 50 is formed in a wavy configuration while the inner edge 51C of the diaphragm 50 is formed in a flat configuration.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vibration unit for an acoustic module, comprising:

an encircling frame defining a vibration cavity therewithin and a centerline;

a vibration member disposed in said vibration cavity of said encircling frame; and a suspension comprising an elastic diaphragm having an inner edge extended from said vibration member and an outer edge extended to said encircling frame, wherein along a circumferential direction, said outer edge of said diaphragm is formed in periodically sinusoid configuration and is defined a plurality of outer edge upper peaks located above said centerline of said encircling frame and a plurality of outer edge lower peaks located below said centerline of said encircling frame, wherein along a radial direction, said diaphragm is extended in a waveless manner, such that said vibration member is ensured to be reciprocatingly moved in a linear direction for sound reproduction.

2. The vibration unit, as recited in claim 1, wherein an amplitude of said each of said outer edge upper peaks equals to an amplitude of each of said outer edge lower peaks.

3. The vibration unit, as recited in claim 1, wherein said vibration member defines a centerline, wherein said inner edge of said diaphragm is formed in periodically sinusoid configuration and is defined a plurality of inner edge upper peaks located above said centerline of said vibration member and a plurality of inner edge lower peaks located below said centerline of said vibration member, wherein an amplitude of each of said inner edge upper peaks equals to an amplitude of each of said inner edge lower peaks.

4. The vibration unit, as recited in claim 3, wherein said amplitude of each of said inner edge upper and lower peaks is gradually reduced from said inner edge of said diaphragm to said outer edge thereof and toward a centerline of said encircling frame.

5. The vibration unit, as recited in claim 1, wherein said suspension further comprises a frame retaining edge integrally extended from said outer edge of said diaphragm to affix at said encircling frame and a retaining layer integrally extended from said inner edge of said diaphragm to embed said vibration member under said retaining layer, so as to retain said vibration member within said vibration cavity.

6. The vibration unit, as recited in claim 1, wherein a phase of said inner edge of said diaphragm is synchronized with a phase of said outer edge of said diaphragm.

7. The vibration unit, as recited in claim 1, wherein said diaphragm has a uniform thickness between said inner and outer edges.

8. The vibration unit, as recited in claim 1, wherein said outer edge upper peaks are located not higher than an upper side of said encircling frame and said outer edge lower peaks are located not lower than a lower side of said encircling frame.

9. The vibration unit, as recited in claim 1, wherein said amplitude of each of said outer edge upper and lower peaks is gradually reduced from said outer edge of said diaphragm to said inner edge thereof and toward said centerline of said vibration member.

10. The vibration unit, as recited in claim 1, wherein said vibration member defines a centerline, wherein said inner edge of said diaphragm has a flat configuration extended to said vibration member and aligned with said centerline of said vibration member.

11. A vibration unit for an acoustic module, comprising:

an encircling frame defining a vibration cavity therewithin;

a vibration member disposed in said vibration cavity of said encircling frame; and a suspension comprising an elastic diaphragm having an inner edge extended from said vibration member and an outer edge extended to said encircling frame, and a frame retaining edge integrally extended from said outer edge of said diaphragm to affix at said encircling frame and a retaining layer integrally extended from said inner edge of said diaphragm to embed said vibration member under said retaining layer, so as to retain said vibration member within said vibration cavity.

12. The vibration unit, as recited in claim 11, wherein along a circumferential direction, at least one of said inner edge and said outer edge of said diaphragm is formed in periodically sinusoid configuration and is defined a plurality of upper peaks located above a centerline of said vibration member and a plurality of lower peaks located below said centerline of said vibration member, wherein an amplitude of each of said upper peaks equals to an amplitude of each of said lower peaks, wherein along a radial direction, said diaphragm is extended in a waveless manner.

13. The vibration unit, as recited in claim 12, wherein said upper peaks are located not higher than an upper side of said vibration member and said lower peaks are located not lower than a lower side of said vibration member.

14. The vibration unit, as recited in claim 12, wherein said upper peaks are aligned along a radial direction of said vibration member, and said lower peaks are aligned along said radial direction of said vibration member.

15. The vibration unit, as recited in claim 12, wherein said amplitude of each of said upper and lower peaks is gradually reduced from said inner edge of said diaphragm to said outer edge thereof and toward said centerline of said encircling frame.

16. The vibration unit, as recited in claim 12, wherein said amplitude of each of said upper and lower peaks is gradually reduced from said outer edge of said diaphragm to said inner edge thereof and toward said centerline of said encircling frame.

17. The vibration unit, as recited in claim 12, wherein said diaphragm has a uniform thickness between said inner and outer edges.

18. The vibration unit, as recited in claim 12, wherein a phase of said inner edge of said diaphragm is synchronized with a phase of said outer edge of said diaphragm.

19. The vibration unit, as recited in claim 12, wherein at least one of said inner edge and outer edge of said diaphragm has a flat configuration aligned with said centerline of said vibration member.

20. The vibration unit, as recited in claim 11, wherein said diaphragm also has a wave shape correspondingly extended between said inner and outer edges along a circumferential direction, and defines a plurality of peak lines radially and outwardly projected from said vibration member to said encircling frame, wherein along a radial direction, said diaphragm is extended in a waveless manner.

* * * * *